US008118382B2

(12) United States Patent
Hampel et al.

(10) Patent No.: US 8,118,382 B2
(45) Date of Patent: Feb. 21, 2012

(54) METHOD FOR MEASURING A GAP BETWEEN AN INTERMEDIATE IMAGING MEMBER AND A PRINT HEAD USING THERMAL CHARACTERISTICS

(75) Inventors: Robert Roy Hampel, Tualatin, OR (US); Martin William Reagan, Aurora, OR (US); Alan Duane Besel, Ridgefield, WA (US); Joseph M. Smith, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/082,586

(22) Filed: Apr. 8, 2011

(65) Prior Publication Data

US 2011/0181647 A1 Jul. 28, 2011

Related U.S. Application Data

(62) Division of application No. 11/977,067, filed on Oct. 23, 2007, now Pat. No. 7,926,892.

(51) Int. Cl.
*B41J 25/308* (2006.01)

(52) U.S. Cl. ..... 347/8

(58) Field of Classification Search ..... 347/8
See application file for complete search history.

(56) References Cited

U.S. PATENT DOCUMENTS

| | | | | |
|---|---|---|---|---|
| 5,518,324 | A | 5/1996 | Campbell et al. | |
| 5,600,408 | A * | 2/1997 | Horiuchi et al. | 399/39 |
| 5,610,636 | A * | 3/1997 | Hanabusa et al. | 347/8 |
| 5,772,339 | A | 6/1998 | Yamaguchi | |
| 6,249,300 | B1 | 6/2001 | Kerr et al. | |
| 6,629,787 | B2 | 10/2003 | Lee et al. | |
| 6,736,557 | B2 | 5/2004 | DeVore et al. | |
| 6,921,217 | B2 | 7/2005 | Tsuji | |
| 7,063,468 | B2 | 6/2006 | Youn et al. | |
| 7,748,838 | B2 | 7/2010 | Oishi | |
| 7,766,472 | B2 | 8/2010 | Oishi | |
| 2005/0179712 | A1 * | 8/2005 | Lee | 347/8 |

* cited by examiner

*Primary Examiner* — Laura Martin

(74) *Attorney, Agent, or Firm* — Maginot, Moore & Beck, LLP

(57) ABSTRACT

A method uses temperature measurements for a print head and an imaging member to identify a distance between a print head and an imaging member. The method determines whether the print head at the print position is too close to the imaging member to identify the gap distance without damage to the print head. Then, if the print head is not too close, the print head is heated to quantify the heat sink effect of the imaging member on the print head. This effect is related to a heat transfer function that identifies the gap distance between the imaging member and the print head.

11 Claims, 5 Drawing Sheets

METHOD FOR MEASURING A GAP BETWEEN AN INTERMEDIATE IMAGING MEMBER AND A PRINT HEAD USING THERMAL CHARACTERISTICS

PRIORITY CLAIM

This application is a divisional application that claims priority from commonly assigned, U.S. patent application Ser. No. 11/977,067, which was filed on Oct. 23, 2007, is entitled "Method For Measuring A Gap Between An Intermediate Imaging Member And A Print Head Using Thermal Characteristics," and which will issue as U.S. Pat. No. 7,926,892 on Apr. 19, 2011.

TECHNICAL FIELD

This disclosure relates generally to print head installation in printers having intermediate imaging members and, more particularly, to print head installation in printers having heated print heads and intermediate imaging members.

BACKGROUND

Many document generating systems convert document data into control signals that operate an ink ejecting print head in a printer, for example, to produce an image of a document with ink drops emitted from the print head. In some of these systems, an electronic version of a document from a personal computer (PC) or other type of computing system is used to produce the document on media, such as paper or film. In other systems, an electronic document is generated by scanning an original hard copy document with a light source to generate reflected light representative of the document. The light signals are converted into electrical signals that may be stored in an electronic memory. The document generating system typically includes an image processor that manipulates the electronic data representing a document to a processed form of the document that is used to produce the hard copy version of the document.

A print engine may be used to manage the subsystems that cooperate to generate a document on media. These subsystems include the image processor and the components that apply or transfer marking material, such as ink, to media to form a document. For example, a direct marking system may include a marking material source, a print head, an image substrate, and a fuser. The marking material source may be an ink cartridge or a solid ink subsystem. Solid ink subsystems have a loader in which sticks of solid ink are loaded and transported to an ink melter that heats the ink sticks to a melting point to generate liquid ink. The liquid ink is collected in a reservoir to supply the print head.

The print head in a document generating system is typically comprised of a plurality of ink jet nozzles arranged in a matrix. The ink jet nozzles are coupled by capillaries to the ink supply. They also include piezoelectric elements that are selectively excited by electrical signals from the print engine to eject ink from the capillaries onto an image substrate. In some systems, the print head may be a single print head supported on a carriage so the print head traverses back and forth in a horizontal path across the face of the image substrate. In other systems, multiple print heads that remain stationary and cover a portion of the image substrate may be used. For example, four print heads, each one covering one quarter of the width of the image substrate, may be mounted on two carriages with each carriage having two print heads. The four print heads are arranged in a staggered two by two matrix opposite the image substrate. Some systems may have one or more print heads that cover the entire width of the image substrate. The carriages are typically movable so the print heads may be moved from a parked or non-imaging position to a print position. In the parked position, the print heads and the imaging member have the greatest separation between them to provide access to the marking unit components. Moving the carriage to the print position brings the print heads proximate the imaging member surface so the heads and the member are separated by a short gap.

Referring to FIG. 1, a side view is shown of a prior art ink printer 100 that corresponds to the description of a printer provided above. As shown in FIG. 1, the ink printer 100 may include an ink loader 96, an electronics module 98, a paper/media tray 92, a print head 50, an intermediate imaging member 52, a drum maintenance subsystem 54, a transfix subsystem 58, a wiper subassembly 60, a paper/media preheater 64, a duplex print path 68, and an ink waste tray 70. In brief, solid ink sticks are loaded into ink loader 96 through which they travel to a melt plate (not shown). At the melt plate, the ink stick is melted and the liquid ink is diverted to a reservoir in the print head 50. The print head 50 includes one or more heaters to help keep the melted ink in a liquid state. The melted ink is ejected by piezoelectric elements to form an image on the intermediate imaging member 52 as the member rotates. Member 52 is called an intermediate imaging member because an ink image is formed on the member and then transferred to media in the transfix subsystem. As shown in FIG. 1, the member 52 is a rotating cylindrical drum. The circumferential surface of the drum is typically manufactured with anodized aluminum.

An intermediate imaging member heater is controlled by a controller to maintain the imaging member within an optimal temperature range for generating an ink image and transferring it to a sheet of recording media. A sheet of recording media is removed from the paper/media tray 92 and directed into the paper pre-heater 64 so the sheet of recording media is heated to a more optimal temperature for receiving the ink image. A synchronizer delivers the sheet of the recording media so its movement between the transfix roller in the transfer subsystem 58 and the intermediate image member 52 is coordinated for the transfer of the image from the imaging member to the sheet of recording media. Sometimes the components that eject ink onto the imaging member, the imaging member, and the components that transfer the image from the imaging member to a media sheet are collectively denoted as a marking unit for a printer.

During the printer manufacturing process, the print heads are among the last components to be installed in the marking unit of the printer to avoid or reduce accidental damage to a print head or drum. After the print heads are installed, the gap between the imaging member and the print head is measured to help ensure the components are within tolerance for the distance that enables accurate placement of ink onto the imaging member. Measurement of this gap and the alignment of the print head with the imaging member is performed with mechanical shim tools or electrical tools, such as a capacitance probe or eddy-current probe. For example, capacitance probes may be mounted to a mask that is attached to the print head. Monitoring equipment provides an excitation voltage to measure capacitances between the probes in the mask on the print head and the imaging member. The measurements obtained from the mask are used to calculate the distance between the print heads and the imaging member. The mask has a limited life arising from the attachment process and the accuracy of the measurement process is subject to the dielectric constant of the air gap, which is affected by the humidity of the air. Additionally, this method is not readily accessible to field technicians who install replacement print heads in printers at customer facilities. Another tool that may be used to measure a gap between an imaging member and a print head is an electronic feeler gauge. Like the capacitive probe mask, this tool does not wear well and is generally unavailable for field installations. More robust methods of measuring the imaging member/print head gap are desirable.

SUMMARY

A method of measuring a gap between a print head and an imaging member enables measurement of the gap without the use of external tools. The method uses temperature measurements for a print head and an imaging member as well as empirically derived heat transfer function coefficients to identify a distance between a print head and an imaging member. The method includes heating an imaging member to a predetermined imaging member temperature, activating a heat source to heat a print head to a predetermined print head temperature while the print head is at a non-imaging position with reference to the imaging member, moving the heated print head to a print position with reference to the imaging member, the print position being closer to the imaging member than the non-imaging position, deactivating the heat source, measuring a first temperature for the print head in response to a first time period expiring, and identifying a distance between the print head in the print position and the imaging member from the first temperature measured for the print head, the predetermined imaging member temperature, and a difference between the predetermined print head temperature and the first temperature measured for the print head.

BRIEF DESCRIPTION OF THE DRAWINGS

The foregoing aspects and other features of a method and system in which a gap between an intermediate imaging member and a print head may be identified with reference to thermal characteristics of a printer are explained in the following description, taken in connection with the accompanying drawings, wherein.

DETAILED DESCRIPTION

Figure 1:
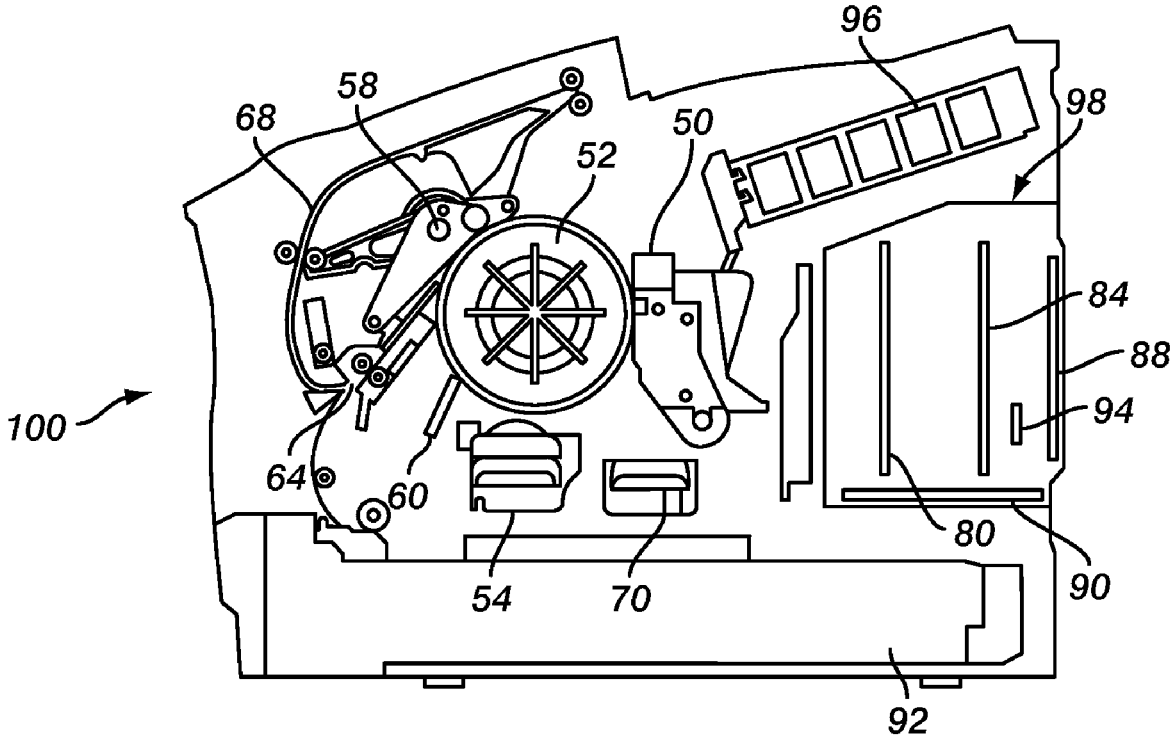
FIG. 1 PRIOR ART
FIG. 1 is a side view of a prior art ink jet printing system that forms images of documents on a rotating intermediate image member.
Figure 2:
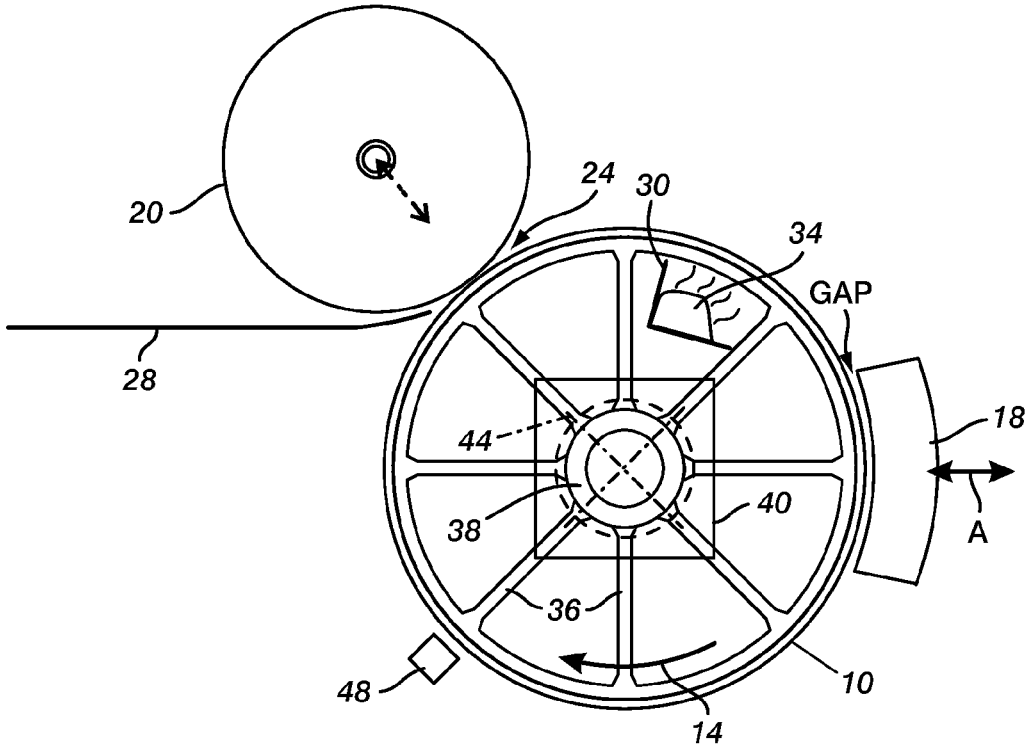
FIG. 2 PRIOR ART
FIG. 2 is a side view of a marking unit in another prior art printer.
Figure 3:
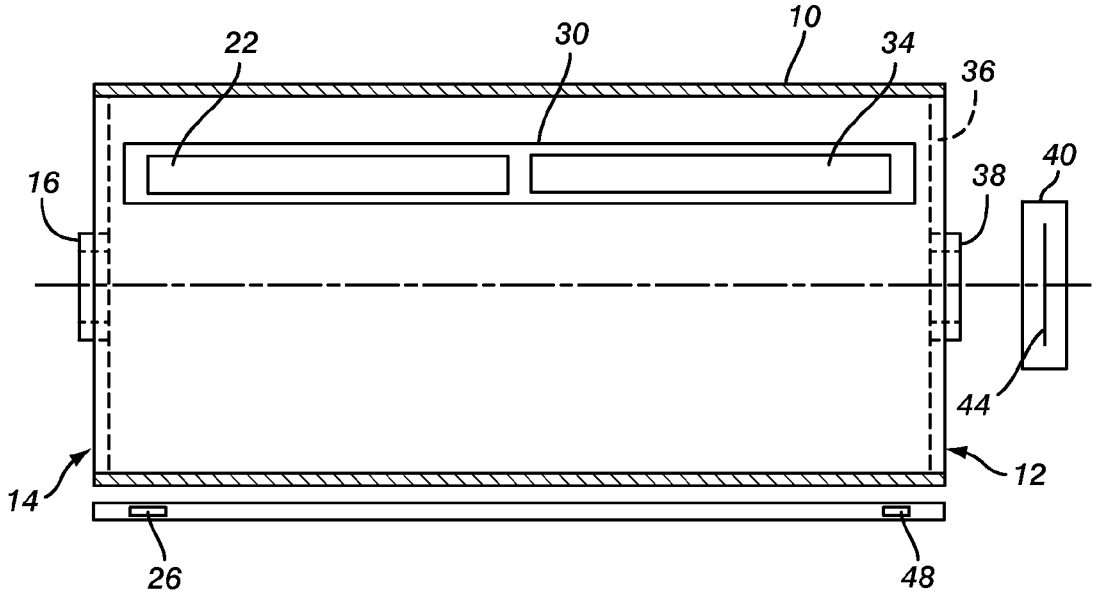
FIG. 3 PRIOR ART
FIG. 3 is longitudinal cross-sectional view of the imaging member shown in the marking unit of FIG. 2

FIG. 2 is a side view of marking unit components in another prior art printer showing major components for forming an image and a portion of the cooling system for an image receiving member. The marking unit includes an intermediate imaging member 10 onto which melted ink is ejected by a heated print head 18 as the drum rotates in the direction 14. One or more revolutions of the member 10 are required before an image is formed on the member. A transfer or transfix roller 20 is displaceable towards and away from the member 10 to form a nip 24 between them in a selective manner. The nip 24 is formed as an image on the member 10 approaches the transfer roller 20. A media path 28 supports recording media and directs media into the nip 24. Delivery of recording media to the nip 24 is also synchronized with the approach of an image towards the transfer roller 20. After passing through the nip to receive an image from the image receiving member 10, the media exits to the output tray on a media output path (not shown).

As shown in FIG. 2, the print head 18 pivots bi-directionally, as shown by the arrow A, between a non-imaging position and a print position. In the print position, the print head 18 is closer to the imaging member 10 than when it is in the non-imaging position, which is outboard of the imaging member. The print position is a position at which the print head is operated to eject ink onto an ink receiving member, such as an intermediate surface or an image substrate. The non-imaging position is one at which the print head is not operated to form an image with ink drops. The non-imaging position is typically a stationary position that may correspond to the greatest distance along the range of motion for the print head from its print position. The non-imaging position, as used herein, may refer to a variable, incremental, or moving position for the print head other than its print position. A non-imaging position for the print head used to identify the gap at the print position may be selected with reference to the distances and/or speeds of the printing system configuration.

The gap between the print head 18 in the print position and the imaging member is important to the print quality obtained with the marking unit. The ink ejected by the print head 18 travels across this gap before landing on the imaging member. The masses of the ink drops and the force with which they are expelled are directly dependent upon this gap distance. Precise placement of the ink drops is very important so the tolerance for this gap is tight. In one example, a printing device has a gap of approximately 0.025 inches with a tolerance range of ±0.005 inches. Accurate alignment of the print head in the print position with the imaging member requires expensive equipment and a time-consuming procedure during manufacture of a printer. The equipment used for this alignment is not available for print heads replaced at customer facilities. Moreover, the down time typically required for this process, which is usually thirty minutes or more, is not appreciated by customers.

A method of measuring the gap distance between a print head in the print position and an imaging member has been developed that can be performed by a printer at a customer's site. The method is based on a heat transfer equation related to the exchange of heat between two metal plates that are separated by an air gap. Using empirical methods for collecting data and regression analysis of the collected data, the dominant terms of the heat transfer function and their related coefficients can be identified. The terms of the function that do not appreciably contribute to the transfer of heat across the gap may be ignored without a significant loss in the accuracy of the measurement for the gap distance. Through the process described below, a predetermined print head temperature, a predetermined imaging member temperature, a temperature measurement for the print head when the print head is in the print position, and a difference between the predetermined print head temperature and the temperature measured for the print head are correlated to terms in the transfer function to identify the distance between the print head in the print position and the imaging member. While reference is made to a print head or print heads in the gap measurement method described below, the reader should understand that the thermal mass of the print head involved in measuring a gap may refer to the full mass of the print head assembly or a select portion or portions of the head or mass heated in association with a print head.

Figure 4:
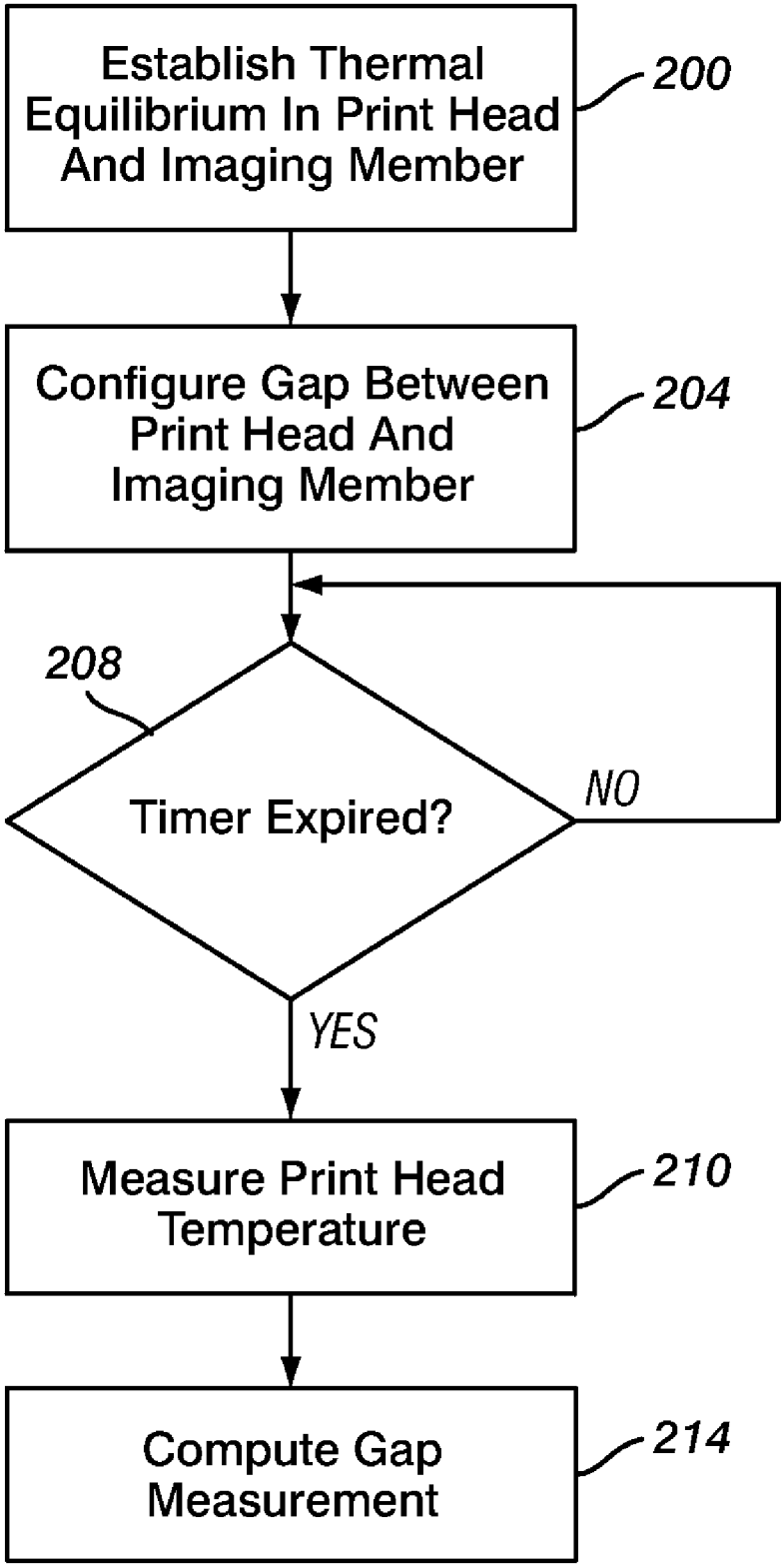
FIG. 4 is a flow diagram of a general process for measuring a distance between a print head and an imaging member.

FIG. 4 is an overview of a process that may be used to measure the gap between a print head in a print position and an imaging member. The process begins with the establishment of thermal equilibrium over an appropriate region in the print head and imaging member at a predetermined temperature (block 200). As is apparent from the discussion below, thermal equilibrium may be achieved in a number of ways. What is important is that the print head and the imaging member reach a temperature that remains stable with the input of minimal energy only. The predetermined temperature may be a temperature within the operating range for the print head and imaging member during printing operations. After thermal equilibrium has been established, the gap is configured for the measurement (block 204). The terms thermal equilibrium or thermal stability are intended to refer to the degree of thermal equilibrium in the region of interest and a targeted level of thermal stability in the components of a particular assembly. The factors affecting thermal stability vary in several ways based on the configuration of the components and may include, for example, mass, geometry, material composition, and relationship between components. Consequently, these terms are not intended to infer absoluteness or specific values for the process.

Gap configuration refers to the thermally stable print head and imaging member being positioned relative to one another and that the energy input to the print head be terminated. A heat transfer function relates a body at one temperature giving up its heat to another body located across a separating air gap. In the case of a marking unit, the print head is heated to a predetermined temperature that is greater than the predetermined temperature to which the imaging member is heated. Thus, once energy to the print head is removed, heat dissipates across the gap to the imaging member. For example, in one embodiment, the print head is regulated to remain within a temperature range of approximately 115 to approximately 120° C. while the imaging member is kept within a temperature range of approximately 30 to approximately 50° C. Consequently, when energy to the print head is terminated, heat flows across the gap to the larger imaging member at the lower thermal potential.

With continued reference to FIG. 4, a timer is set and the process waits for the timer to expire (block 208). The timer is set to a value that allows the temperature of the print head to drop significantly to confirm the heat loss is in the direction of the imaging member through the thermal conductance of the air in the gap. In one embodiment, this time period is approximately 100 seconds. Upon the expiration of the timer, the temperature of the print head is measured using the print head temperature sensor (block 210). Using the measured temperature of the print head, the predetermined temperature for the print head, and the predetermined temperature for the imaging member, the gap distance can be computed (block 214). The computation requires the empirically derived coefficients for the transfer function.

The coefficients for the transfer function are derived by establishing thermal equilibrium conditions at a predetermined temperature in a print head and imaging member configured for a known gap. A profile for the temperature decay of the print head is monitored and stored. This process is repeated for multiple gap distances at various thermal conditions and then regression analysis is used to determine the coefficients for a solution to the heat transfer function. One regression analysis program used to derive coefficients used in one embodiment is the DOE Pro XL regression analysis program available from Air Academy Associates of Colorado Springs, Colo. The heat transfer function may be expressed in the following form:

$$Q_x = hA\frac{dT}{dx}\left(\frac{T_H - T_D}{\text{gap}}\right),$$

where $Q_x$ is the heat conducted, h is thermal conductivity of the fluid, which in the print head gap case is air, A is the cross-sectional area, dT/dx is the temperature gradient as a function of distance along the normal and the parenthetical quantity is a ratio of a difference between the print head temperature and the imaging member temperature to the distance across a gap. After the experimental data is processed by the regression analysis software and the most significant terms are identified, the transfer function may be used to solve for the gap distance as follows: $\text{gap}=C_1T_0T_DT_H+C_2T_D^2+C_3T_0T_D+C_4T_H^2+C_5T_0T_D+C_6T_0^2+C_7$ where $T_0$ and $T_H$ is the initial temperature and final temperature of the print head, respectively, $T_D$ is the temperature of the imaging member, and $C_1 \ldots C_N$ are constant coefficients obtained from the regression analysis. Of course, if greater accuracy is desired, other terms in the expression of the gap solution and their coefficients may be retained. A reduced term coefficient solution, however, has been found sufficient for the gap measurement and tolerance described above. Once these coefficients have been determined from empirical data and the regression analysis, a gap can be identified from the predetermined temperature for a print head, the predetermined temperature for an imaging member, and the measured change in temperature in the print head after the gap is configured and heat to the print head is turned off.

Figure 5:
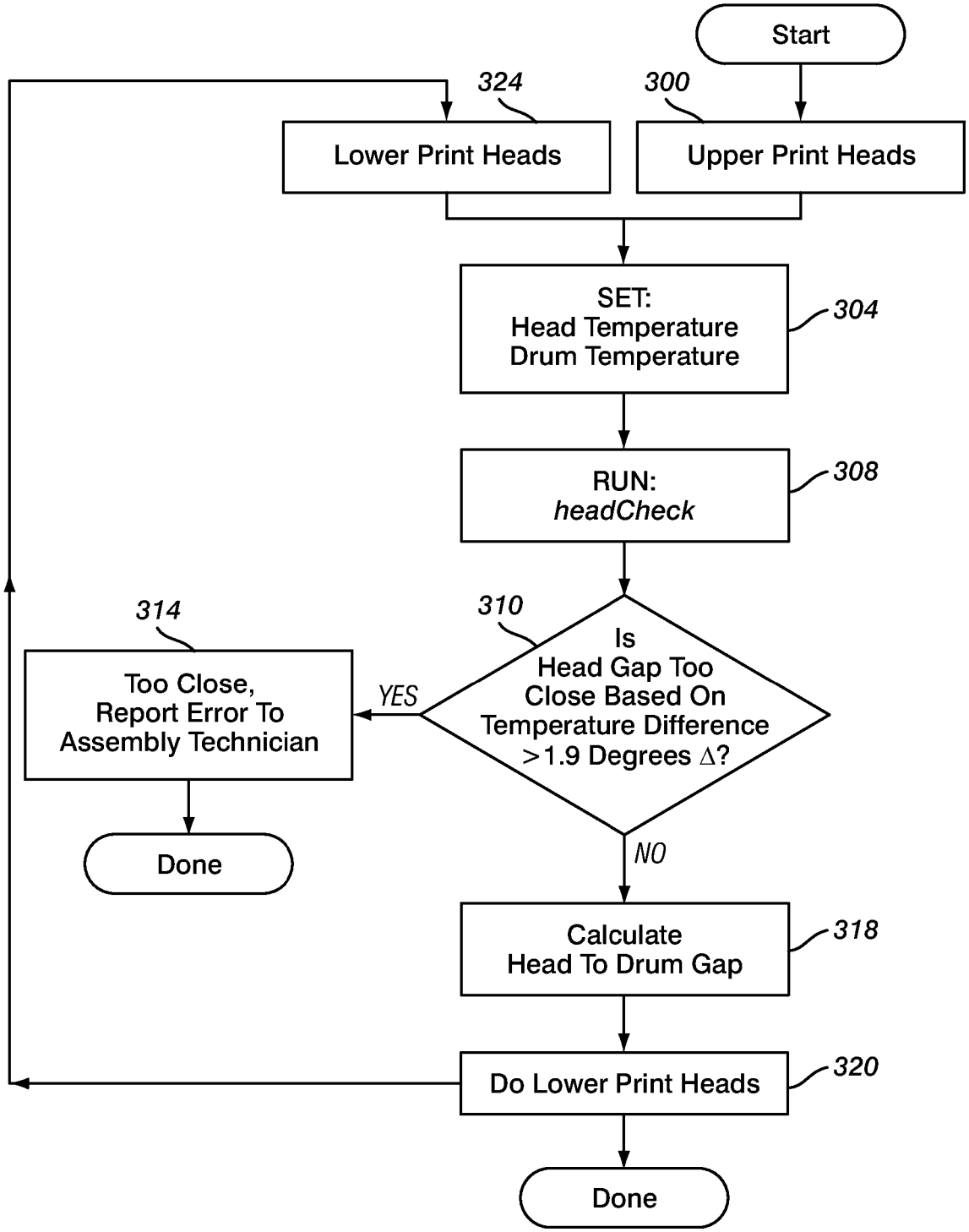
FIG. 5 is a flow diagram of an exemplary implementation of the general process shown in FIG. 2.

In more detail, the process for measuring a gap between a print head and an imaging member is shown in FIG. 5. The process begins by confirming that all of the print heads are in a non-imaging position and selecting one of the two print head arrays in a printer (block 300), which in FIG. 5 is the upper staggered full width array or SFWA. As used herein, SFWA refers to an array of at least two or more print heads that are coupled together in a unitary construction so the print heads move as a unit and a single temperature may be measured for the unit. Thus, the method described herein may be used with an array of multiple print heads organized in this type of unitary construction or it may be used with single print heads that are moved independently of one another. For example, the printer in this embodiment has two carriages. Each carriage spans the width of the imaging member and the two carriages are arranged vertically so the two print heads mounted to one carriage are above the two heads mounted to the other carriage. One carriage and two print heads, in this example, form a SFWA. When each SFWA is moved to the print position, the four print heads of the two SFWAs cover the width of the imaging member in a staggered pattern, such as $x^Xx^X$. The controller for the gap alignment process activates the print head heaters for the two print heads in the selected SFWA, which is being moved towards and away from the imaging member for the distance measurement process. The controller for the process also activates the heaters for the imaging member, which in one embodiment rotates while it is heated to the equilibrium condition. Rotation of the imaging member may avoid localized thermal hot spots and changes in dimensional stability. The temperature of the SFWA and the imaging member is monitored until a stable predetermined temperature is reached for the print heads and imaging member (block 304).

While the process is being described with reference to a rotating imaging member, the process may also be applied to other printing configurations. For example, the process may be applied to a direct printing configuration in which ink is ejected directly onto media. In this type of process, the imaging member may be a structural support, guide, or similar component that enables an appropriate gap between a print head and media, which receives the image. The media support that enables the distance between the imaging surface and the print head to be controlled may be stationary or moved by pivoting, translation, or any combination of such or similar motions. These types of motions may be substituted for the descriptions of rotation in the illustrated configuration. Moving is, thus, a more apt description for the broader range of configurations in which the process may be used.

Once thermal equilibrium is reached, a head check is performed (block 308). A head check helps ensure that the print head or SFWA in the print position is not so close to the imaging member that rotation of the imaging member is likely to cause contact with the print head or SFWA in the print position. In one embodiment, the head check is performed by stopping rotation of the imaging member and moving the print head or SFWA into the print position once the imaging member has stopped its rotation. This action brings the print head or SFWA into proximity to the imaging member, which has a lower predetermined temperature than the print head or SFWA. Consequently, heat is transferred to the imaging member from the print head or SFWA across the air gap between them. A temperature controller coupled to the print head or SFWA monitors the temperature of the print head or SFWA on a periodic basis and compares the measured temperature to a predetermined print or SFWA threshold. In response to the measured temperature dropping below the predetermined threshold, the temperature controller generates a signal to cause energy to be input to the print head or SFWA to bring the print head or SFWA back to the predetermined temperature. The temperature of the print head or SFWA continues to be monitored and stored. When the temperature of the print head or SFWA begins to respond to the input of energy and begins to climb, a minimum temperature for the print head or SFWA is identified. This minimum temperature is related to the gap distance between the imaging member and the print head or SFWA. The closer the two bodies are to one another, the more effectively the imaging member acts as a heat sink to the print head or SFWA. Thus, the minimum temperature measured before the print head or SFWA temperature begins to climb indicates the distance of the print head or SFWA from the imaging member. In one embodiment, a difference between the predetermined print head temperature and the minimum temperature that is greater than 1.9° C. indicates the print head or SFWA is too close to rotate the imaging member (block 310) as unintended contact may occur. This relationship is shown graphically in FIG. 6 with the first fluctuation depicted on the left side of the graph. As shown in the graph, the temperature of the print head or SFWA drops to the minimum temperature before it begins to climb towards the predetermined temperature. The temperature actually overshoots the predetermined temperature before the temperature controller terminates the input of energy to heat the print head and before the controller re-establishes the predetermined temperature for the print head.

If the print head is within a distance of the imaging member where movement may result in contact, the imaging member is held in a no-movement relationship and the print heads are moved to a non-imaging or parked position, an error message is displayed to notify the operator of this condition, the test is terminated, and the operator is expected to take appropriate action (block 314). A no-movement distance is a distance between the print head and the imaging member that may result in contact between the print head and the imaging member if the imaging member is rotated or otherwise moved. This distance is empirically derived and reflects a rollout error in the circumference of the imaging member as well as a safety margin related to other variations that may affect the precision of the rotation of the imaging member and process tolerances. Provided the print head or SFWA is at a distance that enables the imaging member to rotate without contacting the print head or SFWA, the gap measurement process continues by rotating the imaging member. This rotation enables the energy input to the imaging member to be distributed over the imaging member to reduce the occurrence of localized hot spots on the imaging member.

Figure 6:
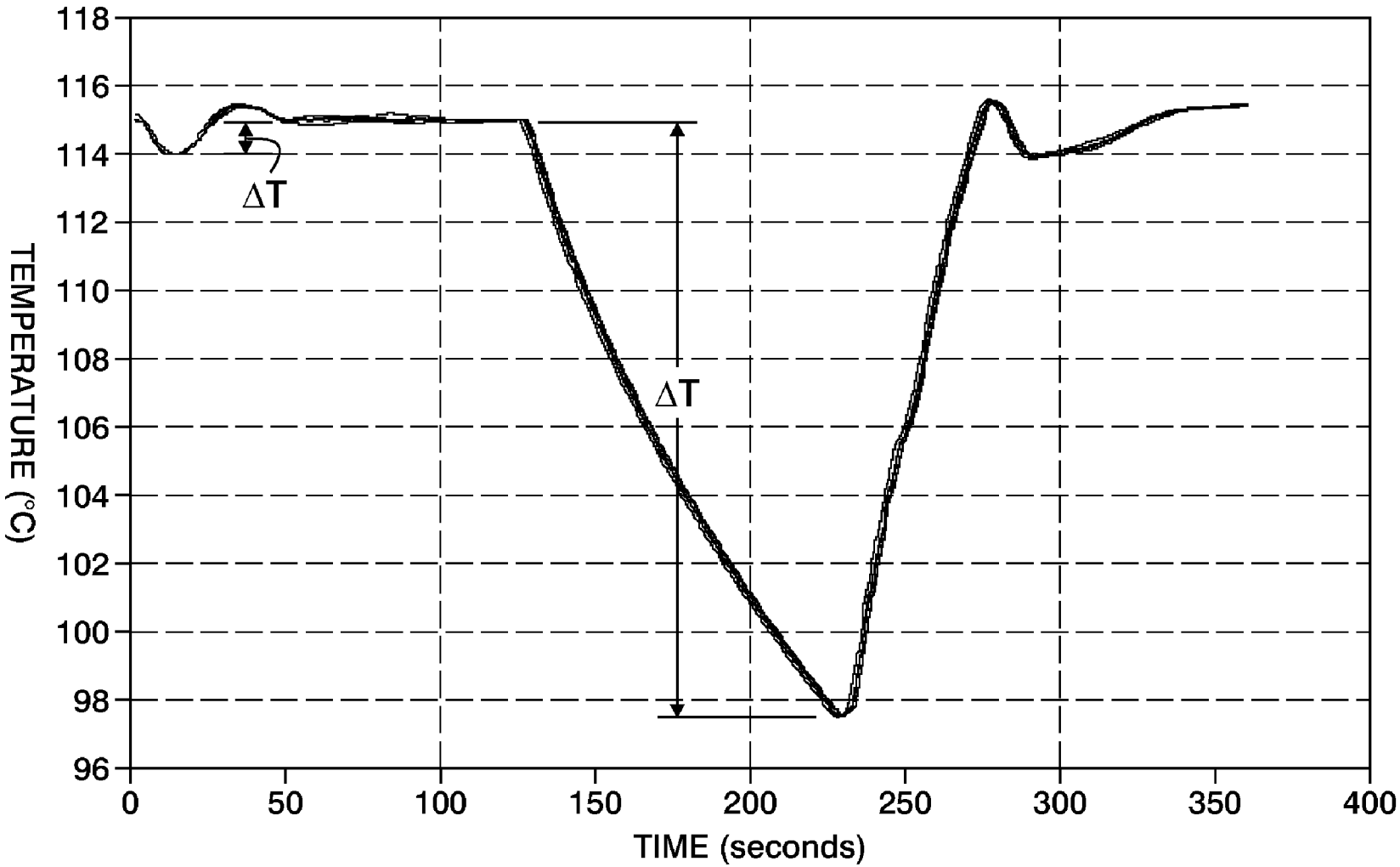
FIG. 6 is a graphical representation of a relationship between print head temperature and time during a performance of the exemplary process described with reference to FIG. 5.

As the process in FIG. 5 continues, the controller re-establishes thermal equilibrium at the predetermined temperature for the print heads and the imaging member in the configured gap, as already noted. Rotation of the imaging member is then stopped and the heater to the print head is deactivated so the temperature controller does not operate the heater to maintain the predetermined temperatures for the print head and the imaging member. A gap check timer is then set and the print head temperature is measured upon expiration of the gap check timer. The drop in the temperature of the print head or SFWA now corresponds more closely to the gap dimensions used in the derivation of the coefficients from the regression analysis described above. The predetermined print head temperature re-established at the beginning of the gap check period, the imaging member temperature measured at the start of the gap check period, and the difference between the predetermined print head temperature and the print head temperature measured at the expiration of the gap check timer are used with the constant coefficients to identify the gap distance (block 318). A graphical representation of the temperature change over the gap check period is also shown in FIG. 6. The process continues by comparing the identified gap distance to the acceptable range for the distance. If the gap is within the tolerance for the distance, the print head or SFWA is moved to a non-imaging or parked position and another print head or other SFWA is selected and the process is repeated (block 320, 324). Otherwise, a signal is generated to indicate to the installer that the SFWA requires further adjustment before printing operations commence.

The gap determination method is not dependent on a rigid step by step process or sequential order, though for purposes of explanation, acts or states of the process have been described individually. Variations in the process may include, for example, termination of the print head heating before the print head is moved to a position relative to the imaging member or the heating may be terminated during the movement of the print head. Variations may be influenced by or used to alter process timing, speed of moving components, coordination of components, or other considerations that thermally influence the print head and/or the imaging member.

To implement the above-described method for a printer having heated print heads, one or more printers are used to collect the thermal data described above for the regression analysis using the selected process. The regression analysis is then performed to identify the equation terms and coefficients that sufficiently identify the gap between the print heads and the imaging member. The coefficients and the instructions to control the marking unit, monitor the temperature of the print heads and imaging member, and compute the gap measurement using the coefficients, temperature measurements, and calculated temperature differentials, are encoded and stored in the print engine for the printers being manufactured. Following installation of a print head or imaging member in a printer so equipped, the process may be initiated through a user interface for the printer. The printer then establishes the thermal equilibrium conditions at predetermined temperatures, configures the gap, measures the temperatures at the appropriate times, and computes the gap distance. The result of this computation may be displayed on the user interface or a go/no-go signal may be generated to inform the user that the replaced unit is or is not within tolerance. Appropriate action may then be taken.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from patentees and others.

We claim:

1. A method for identifying a distance between a print head and an imaging member comprising:

moving an imaging member;

activating a print head heater to heat a print head to a first predetermined temperature;

activating an imaging member heater to heat an imaging member to a second predetermined temperature;

stopping movement of the imaging member;

moving the print head from a non-imaging position to a print position;

measuring a minimum temperature for the print head in response to a temperature sensor detecting a temperature of the print head being less than a predetermined threshold; and identifying from the minimum temperature measured for the print head whether the print head in the print position is at or within a no-movement distance from the imaging member.

2. The method of claim 1 further comprising:

moving the imaging member in response to the print head being at a distance from the imaging member that is greater than the no-movement distance;

stopping the movement of the imaging member in response to the imaging member reaching the second predetermined temperature;

deactivating the print head heater;

measuring a first temperature in the print head in response to a first time period expiring; and identifying a distance between the print head and the imaging member from the first temperature measured for the print head, the second predetermined temperature, and a difference between the first temperature measured for the print head and the first predetermined temperature.

3. The method of claim 1 further comprising:

moving the print head to a non-imaging position;

moving the imaging member;

activating a second print head heater to heat a second print head to a third predetermined temperature;

stopping movement of the imaging member;

moving the second print head from a non-imaging position to a print position;

measuring a minimum temperature for the second print head in response to a temperature sensor detecting a temperature for the second print head that is less than a second predetermined threshold; and identifying from the minimum temperature measured for the print head whether the print head in the print position is at or within a no-movement distance from the imaging member.

4. The method of claim 2 further comprising:

moving the imaging member in response to the second print head being at a distance from the imaging member that is greater than the no-movement distance;

stopping the movement of the imaging member in response to the second predetermined temperature being reached;

deactivating the second print head heater;

measuring a first temperature in the second print head in response to a first time period expiring; and identifying a distance between the second print head and the imaging member from the first temperature measured for the second print head, the second predetermined temperature, and a difference between the first temperature measured for the second print head and the third predetermined temperature.

5. The method of claim 1 wherein the print head is a print head in a staggered full width array (SFWA), the print head heater activation activates a heat source operatively connected to print heads in the SFWA to heat the print heads in the SFWA while the SFWA is at a non-imaging position with reference to the imaging member, the print head movement moves the SFWA to the print position to move the print heads in the SFWA to the print position, the print position being closer to the imaging member than the non-imaging position, the minimum temperature measurement measures a minimum temperature for the print heads in the SFWA in response to a sensed temperature for the print heads in the SFWA being less than the first predetermined threshold, the identification of the print head being at or within the no-movement distance identifies from the minimum temperature measured for the SWFA whether the SFWA in the print position is at or within the no-movement distance from the imaging member.

6. The method of claim 5 further comprising:

moving the imaging member in response to the SFWA being at a distance from the imaging member that is greater than the no-movement distance;

deactivating the heat source for the SFWA;

measuring a temperature for the print heads in the SFWA in response to a first time period expiring; and identifying a distance between the SFWA in the print position and the imaging member from the temperature measured for the print heads in the SFWA, the second predetermined temperature, and a difference between the first predetermined temperature for the SFWA and the temperature measured for the print heads in the SFWA.

7. The method of claim 6 further comprising:

moving the SFWA to a non-imaging position;

activating a heat source operatively connected to print heads in a second SFWA to heat the print heads in the second SFWA to a third predetermined temperature while the second SFWA is at a non-imaging position with reference to the imaging member;

stopping movement of the imaging member;

moving the second SFWA to a print position with reference to the imaging member, the print position being closer to the imaging member than the non-imaging position;

measuring a minimum temperature for the print heads in the second SFWA in response to a sensed temperature for the print heads in the second SFWA being less than a second predetermined SFWA threshold temperature; and identifying from the minimum temperature measured for the print heads in the second SFWA whether the second SFWA in the print position is at or within a no-movement distance from the imaging member.

8. The method of claim 7 further comprising:

moving the imaging member in response to the second SFWA being at a distance from the imaging member that is greater than the no-movement distance;

deactivating the heat source operatively connected to the print heads in the second SFWA;

measuring a temperature for the print heads in the second SFWA in response to a second time period expiring; and identifying a distance between the second SFWA and the imaging member from the temperature measured for the print heads in the second SFWA, the second predetermined temperature, and a difference between the temperature measured for the print heads in the second SFWA and the third predetermined temperature.

9. A method for measuring a gap between a staggered full width array (SFWA) and an intermediate imaging member comprising:

heating an intermediate imaging member to a first predetermined temperature;

activating at least one heat source to heat print heads in a SFWA to a second predetermined temperature while the SFWA is at a non-imaging position with reference to the intermediate imaging member;

moving the SFWA to a print position with reference to the intermediate imaging member, the print position being closer to the intermediate imaging member than the non-imaging position;

measuring a minimum temperature for the print heads in the SFWA in response to a sensed temperature for the SFWA being less than a first predetermined threshold temperature;

identifying from the minimum temperature measured for the print heads in the SFWA whether the SFWA in the print position is at or within a no-movement distance from the intermediate imaging member;

moving the intermediate imaging member in response to the SFWA being at a distance from the intermediate imaging member that is greater than the no-movement distance;

deactivating the at least one heat source for the SFWA;

measuring a temperature for the print heads in the SFWA in response to a first time period expiring; and identifying a distance between the SFWA in the print position and the intermediate imaging member from the temperature measured for the print heads in the SFWA, the first predetermined temperature, and a difference between the second predetermined temperature and the temperature measured for the print heads in the SFWA.

10. The method of claim 9 further comprising:

moving the SFWA to a non-imaging position;

activating at least one heat source to heat print heads in a second SFWA to a third predetermined temperature while the second SFWA is at a non-imaging position with reference to the intermediate imaging member;

stopping movement of the intermediate imaging member;

moving the second SFWA to a print position with reference to the intermediate imaging member, the print position being closer to the intermediate imaging member than the non-imaging position;

measuring a minimum temperature for the print heads in the second SFWA in response to a sensed temperature for the second SFWA temperature being less than a second predetermined threshold temperature; and identifying from the minimum temperature measured for the print heads in the second SFWA whether the second SFWA in the print position is at or within a no-movement distance from the intermediate imaging member.

11. The method of claim 10 further comprising:

moving the intermediate imaging member in response to the second SFWA being at a distance from the intermediate imaging member that is greater than the no-movement distance;

deactivating the at least one heat source for the second SFWA;

measuring a temperature for the print heads in the second SFWA in response to a second time period expiring; and identifying a distance between the second SFWA and the imaging member from the temperature measured for the print heads in the second SFWA, the first predetermined temperature, and a difference between the temperature measured for the print heads in the second SFWA and the third predetermined temperature.

* * * * *